United States Patent [19]

Lehmann

[11] 4,376,143

[45] Mar. 8, 1983

[54] METHOD FOR THE SPRAY-COATING OF THE INSIDE OF TUBULAR BODIES HAVING A SEAM

[75] Inventor: Ernst Lehmann, St. Gallen, Switzerland

[73] Assignee: Gema AG Apparatebau, Switzerland

[21] Appl. No.: 355,336

[22] Filed: Mar. 8, 1982

Related U.S. Application Data

[62] Division of Ser. No. 137,395, Apr. 4, 1980, Pat. No. 4,343,436.

[30] Foreign Application Priority Data

Apr. 12, 1979 [DE] Fed. Rep. of Germany ..... 2914960

[51] Int. Cl.[3] ..... B05D 1/02; B05D 1/04; B05D 1/06; B05D 1/34

[52] U.S. Cl. ..... 427/236; 427/28; 427/181

[58] Field of Search ..... 427/28, 181, 236

[56] References Cited

U.S. PATENT DOCUMENTS 3,081,947 3/1963 Walter .
3,248,606 4/1966 Faser .
3,422,795 1/1969 Smith ..... 118/317 X
3,678,336 7/1972 Winkless ..... 118/622

*Primary Examiner*—James R. Hoffman
*Attorney, Agent, or Firm*—Ostrolenk, Faber, Gerb & Soffen

[57] ABSTRACT

A method and apparatus are disclosed for the spray-coating of the interior of a hollow body, one region of which, e.g. a seam, must receive a heavier coating than the remainder of the surface to be sprayed. A single spray coating operation is performed, in which a relatively heavy spray jet is concentrated on the seam and a relatively thin cloud of coating material is used to coat the entire interior surface of the body. Preferably, a cloud of electrostatically charged coating material is formed by an atomizer fed by a feed conduit from which a certain amount of coating material is diverted to be formed into the relatively highly concentrated spray jet directed at the seam. The relatively high-velocity particles of material of the spray jet which is concentrated onto the seam and the relatively low-velocity particles of material of the coating cloud together produce on the seam a thinner layer of material than would normally suffice and which, nonetheless, adheres well.

5 Claims, 5 Drawing Figures

METHOD FOR THE SPRAY-COATING OF THE INSIDE OF TUBULAR BODIES HAVING A SEAM

This is a division of U.S. patent application Ser. No. 137,395, filed Apr. 4, 1980 now U.S. Pat. No. 4,343,436.

BACKGROUND OF THE INVENTION

The present invention relates to a method and apparatus for spray coating the inside of a tubular body having a seam, and particularly a can body. It relates particularly and preferably to a method and apparatus for electrostatically spraying a pulverulent or other powdered coating material by means of a spray jet directed at the seam of the body to be spray-coated.

As long as cans have been used as containers for beverages and foodstuffs, they have been made from so-called tinplate, i.e. steel plate covered with a thin layer of tin. Since it has been realized that direct contact between the food and the tin is undesirable, the inside of tinplate cans is normally sprayed with a thin lacquer. Today so-called three-part cans are predominantly used for foods and beverages. A three-part can consists of a body, constituting the usually cylindrical side walls of the can, a bottom and a top. The can bodies are made from rolled metal plate. After a rectangular piece of plate that is to be made into a can body is rolled, the pair of now adjacent opposite edges are connected by a double-seam or a special welding. The seam or welding requires a thicker coating than the rest of the can body. The reasons for this have been described in detail in German Utility Model No. 76 36 666. The top and bottom of the can are then joined to the can body.

Two approaches have been used in the past to solve the related problems of coating an article which has different bonding strengths for the coating material at different places, and of coating an article with different thicknesses of coating material placed at different places. Either the areas that must be differently coated are coated in separate operations, or else the entire surface of the article must be coated with a uniform thickness at least as great as the maximum thickness of coating required anywhere on the surface of the article. The former method, which involves a separate coating operation for each area that must be coated to a different thickness, employs very expensive spraying apparatus and requires a great amount of time, due to the multiple spraying operations. The latter method is faster and can be done with less expensive equipment but requires a large amount of coating material. In order to minimize total costs, the second approach has been preferred in the past, despite the consumption of excess coating material. Since, however, the coating material is also expensive, it has been proposed in German Utility Model No. 76 36 666, mentioned above, to coat the seams of the can body seams by means of a guide body which concentrates the coating material onto the seams. The remaining portion of the interior of the can is sprayed before or after the seams are sprayed. Thus two operations are employed in order to save coating material.

U.S. Pat. No. 3,081,947 discloses a device for spray coating the interior of a can with a liquid. According to this known method, the spraying apparatus and the can body must be turned relative to each other during the spraying in order to coat all regions of the interior of the can. This procedure requires that the coating material be fed to the spraying apparatus discontinuously. The apparatus used is expensive and prone to breakdowns.

SUMMARY OF THE INVENTION

The object of the present invention is to provide a method and apparatus that solve the problem of coating articles which must be sprayed at different points with different thicknesses of coating material.

It is a further object to do so with a relatively short spraying time for each article sprayed, by using a relatively inexpensive apparatus and using less coating material for each article.

These objects are achieved in accordance with the method of the invention by simultaneously producing both a spray jet, which is substantially directed at the seam of the tubular can body, and a cloud of coating material, which covers an entire longitudinal section of the interior wall of the can body.

The apparatus of the invention has a spray-material feed line. One outlet from the feed line is provided for the production of a relatively concentrated spray jet for coating substantially only the seam, and a second outlet is provided to produce a relatively diffuse cloud of coating material to coat the remainder of the interior surface of the article to be sprayed.

The basic concept of the invention, therefore, is that when different regions of an article are to be treated differently, two streams of coating material are used simultaneously. One jet is directed substantially in a single direction while the other produces a broad cloud of coating material that covers the entire surface to be spray coated. This means that different regions of the surface of an article which are to be treated differently can be spray coated simultaneously in a single spraying operation. Moreover, each region of such an article is provided with a layer having only the minimum thickness that is acceptable for that region. This results in a saving in time of about 50% and in a substantial saving of coating material. No relative rotation of the article and the spraying apparatus is necessary according to the invention.

At present, the requirements that must be satisfied by a coating on a can are stricter than ever. These increased requirements are satisfied by coating the interior of the can with a plastic powder and then fusing and curing the plastic layer. The present invention is particularly suitable for such powder coating.

The coating material of the main cloud and/or of the additional jet spray can also be electrostatically charged as it is sprayed. The electrical charging of coating material is known from Swiss Pat. No. 509,106.

Other objects and features of this invention will become apparent from the following description the accompanying drawings.

DETAILED DESCRIPTION OF THE INVENTION

In what follows, "powder" is to be understood to mean a pulverulent to granular material.

The preferred field of use of the invention is the coating of the inside of cans with a plastic powder. The invention will accordingly be described with respect to this application. However, the invention is not limited to this application.

Figure 1A:
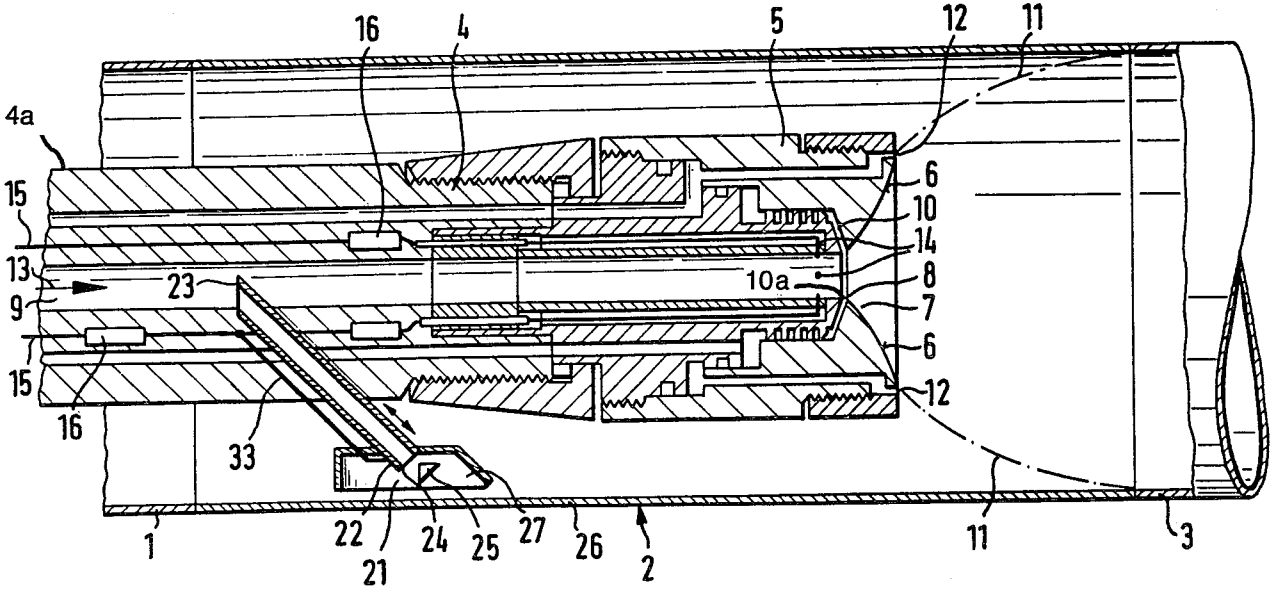
FIG. 1A is a view like that of FIG. 1 showing another preferred embodiment of the invention.
Figure 1:
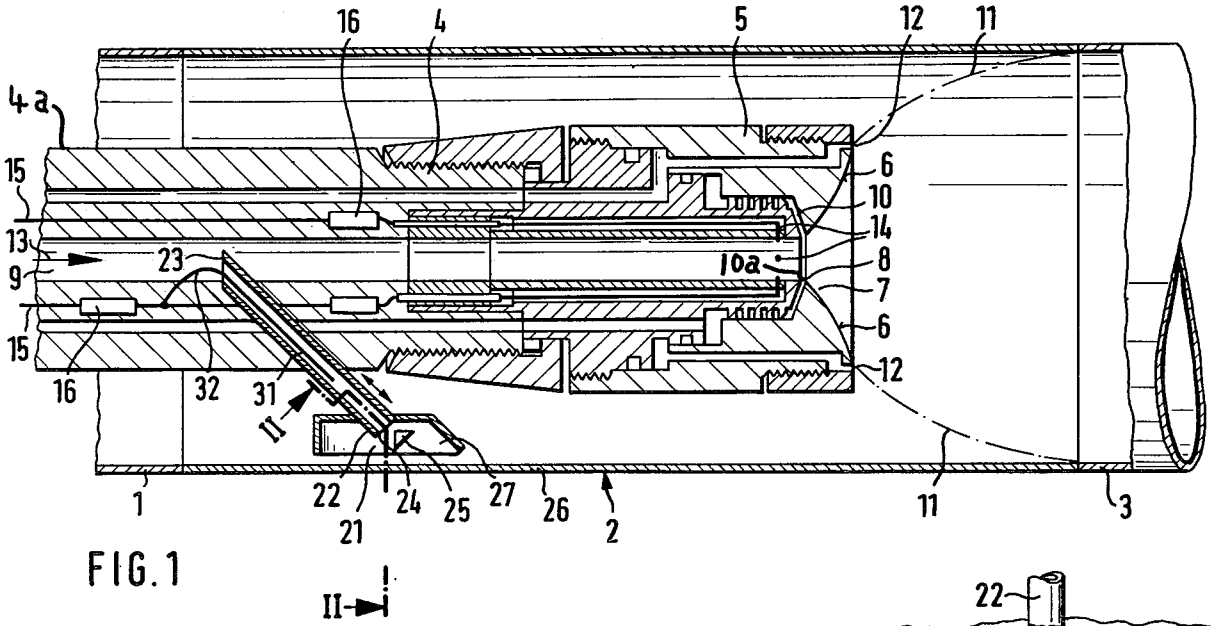
FIG. 1 is a diagrammatic fragmentary axial section through a powder spray apparatus in accordance with the invention.
Figure 2:
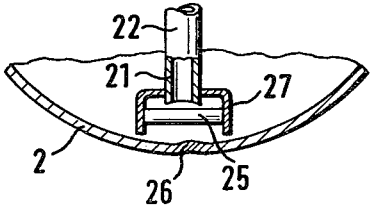
FIG. 2 is a diagrammatic view of a portion along the plane II—II of FIG. 1.

In FIG. 1, tubular can bodies 1, 2 and 3 are delivered in a row, arranged coaxially, from a double seaming or welding machine, not shown. Each can body 1–3 has a respective seam or weld 26. The can bodies 1–3 are delivered to the spray device 4 with their respective seams 26 aligned end to end, so that the seam 26 of each can body 1–3 can be properly sprayed in the manner described below.

A spray device 4 in accordance with the invention is preferably flanged pemanently onto the double-seaming or welding machine. The can bodies 1–3 are fed along the length of the spray device 4 in a row that is generally coaxial with the spray device 4.

The spray device 4 shown in FIG. 1 includes an atomizer head 5 which fits over the downstream end of tube 4*a*. The tube 4*a* is flanged onto the double-seaming or welding machine, as stated above. The atomizer head 5 provides a uniform coating of plastic powder or other material over the entire interior surface of the can body. The coating material is supplied via a feed conduit 9 in the direction indicated by the arrow 13. The feed conduit 9 terminates at its downstream end at the upstream end 8 of a mouth opening 7. The mouth opening 7 progressively widens, so that it has a flared surface 6. A helical gas channel 10 terminates at the upstream end 8 of the mouth opening 7 in an orifice 10*a* that has the shape of an annular slot. A gas is fed through the gas channel 10. The helical shape of the gas channel 10 imparts a twisting or rotational motion to the gas. The rotating gas emerging from the annular orifice 10*a* of the gas channel 10 eddies and atomizes the coating material powder passing from the feed conduit 9 through the mouth opening 7. The shape of the resulting cloud 11 of atomized material can be controlled by a blanket or envelope of gas which emerges from a second annular nozzle 12 which is located surrounding the downstream end of the flared mouth opening 7.

Electrodes 14 are provided extending into the feed conduit 9 near its downstream end for the purpose of electro-statically charging the powdered coating material. Electric power is supplied to the electrodes 14 via the feed wires 15, which include resistors 16. The electrodes 14 are preferably at a DC voltage of between 64 kV and 70 kV.

A supplementary spray device 21 is provided for spray-coating the seam 26 of each can body 1–3. The supplementary spray device 21 includes a tube 22 disposed in one wall of tube 4*a*. The inlet end 23 of tube 22 extends into the feed conduit 9 upstream of the atomizer head 5. The tube 22 is arranged at an acute angle to the feed direction of coating material along the feed conduit 9 and to the feed conduit 9, and the inlet end 23 is cut off perpendicular to the feed conduit 9. As a result, part of the coating material is diverted from the feed conduit 9 into the tube 22. A baffle 25 is provided near the other end 24 of the tube 22. Coating material which has been diverted through tube 22 strikes the baffle 25 and is atomized. A hood 27 surrounds the downstream end 24 of the tube 22 and the baffle 25 for directing the supplementary atomizer jet in concentrated or focused form against the seam 26. The hood 27 concentrates the supplementary spray jet onto the stream 26 of the can body 2 which is to be coated. The atomized material passes in the form of a concentrated spray jet against the seam 26 of the can body 2.

The stream of coating material that is diverted through tube 22 is electrostatically charged by means of an electrode 31, which is a thin wire inserted in the tube 22. The electrode 31 is electrically connected via a connecting wire 32 with the wire 15 to which electrodes 14 are connected and which is at a DC voltage of, for example, 64 kV.

In an alternative embodiment, shown in FIG. 1A, an electrode 33 which is disposed along the length of the exterior of tube 22 is substituted for the electrode 31 a connecting wire 32 shown in FIG. 1. The external electrode 33 extends into the hood or mask 27.

Figure 3:
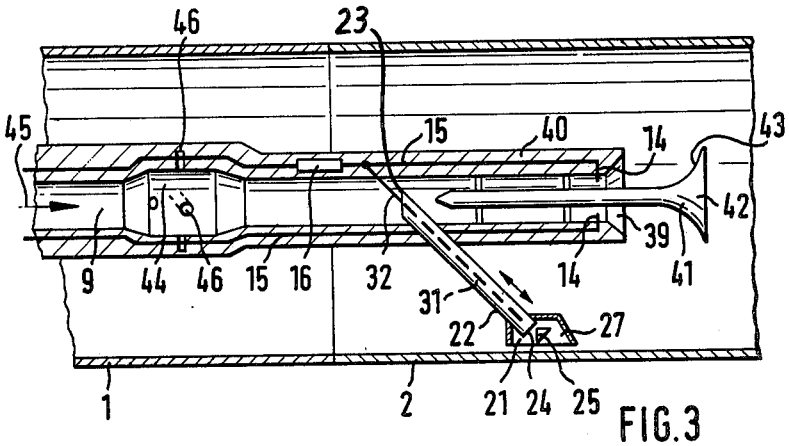
FIG. 3 is a fragmentary axial section of another embodiment for spraying powder in accordance with the invention.

Another preferred embodiment of the invention is illustrated in FIG. 3. FIG. 3 shows a spray device 40 having an atomizer 41 of the type known from Swiss Pat. No. 429,517. The main stream of coating material which is fed via the feed conduit 9 is atomized by a baffle member 42 disposed in the mouth opening 39 of the spray device 40. The baffle member 42 has a baffle plate 43 transverse to the direction of flow in the feed conduit 9. The coating material supplied to the mouth opening 39 via feed conduit 9 is deflected and thereby atomized by the baffle plate 43.

Because the coating material is atomized by the baffle member 42, the spray device 40 does not need the progressively and continuously widening mouth 7 of the embodiment of FIG. 1. The mouth 39 of the feed conduit 9 of the embodiment shown in FIG. 3 is accordingly only slightly beveled outward.

The tube 22 of the supplemental spray device 21 in FIG. 3 is displaceable along its axis so that its inlet end 23 extends to an adjustable extent into the common conduit 9. As a result, it is possible to adjust the amount of material diverted from the common conduit 9 into the supplementary spray device 21 per unit of time.

The coating material tends to vary in its concentration and to become non-homogeneous in the conduit 9. To correct this problem, a generally cylindrical twist chamber or eddy chamber 44 is located in the common conduit 9 upstream of and close to the inlet end 21 of the branching tube 22, as shown in FIG. 3. The eddy chamber 44 is arranged coaxial with the common conduit 9. Gas channels or gas nozzles 46 provided in the wall of spray device 40 discharge into the eddy chamber 44 generally transversely to the direction of flow 45 of the coating material in the common feed conduit 9, in such a manner that the coating material flowing through the feed conduit 9 is caused to eddy in the eddy chamber 44. For this purpose, the gas nozzles 46 are aimed into the eddy chamber 44 substantially circumferentially or tangentially. The coating material is divided up homogeneously by the transverse gas jets in the eddy chamber 44.

Figure 4:
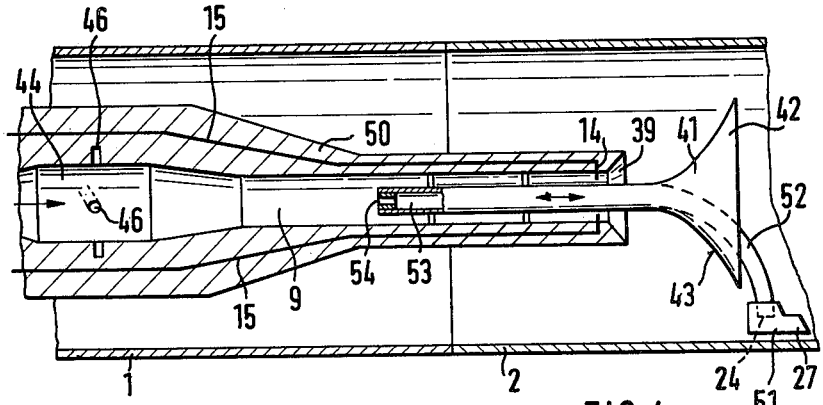
FIG. 4 is a fragmentary axial section of still another embodiment for spraying powder in accordance with the invention.

FIG. 4 shows another embodiment 50 of the spray device of the invention. A supplementary spray device 51 for the delivery of a concentrated atomizer jet aimed at a given point is provided. Unlike the previously described embodiments, the supplementary spray device 51 comprises a curved branch line 52 in place of a straight tube. The spray jet it produces is directed toward the interior of the wall of can body 2. The inlet end 53 of the branch line 52 is located at the upstream end of the baffle member 42, through which the branch line 52 extends. The outlet end 24 of the branch line 52 is located away from the center of the feed conduit 9 and near the portion of the wall of the can body 2 at which it is aimed. A replaceable flow throttle valve 54 is disposed in the inlet section 53 of the branch line 52. By means of the flow throttle valve 54, the amount of coating material diverted into the branch line 52 can be adjusted.

Many variations of the foregoing embodiments of the invention are possible. For instance, it is possible to atomize the supplementary stream of material in the same manner as the main stream. It is only necessary that the supplemental atomizer spray jet be relatively highly focused so as to coat only a single region of the article being coated. A focused jet can be obtained by use of an appropriate means for atomization or of a hood, masks or jet pipe. The coating material could be homogenized in the feed conduit 9 by a twist chamber whose cross section is the same as that of the feed conduit 9 and into which gas channels or gas nozzles 46 discharge in a direction generally transverse to and generally tangential to the circumference of the preferably circular cross-section of the feed conduit 9.

In another embodiment of the invention, the can bodies 1, 2 and 3 are delivered on a known so-called transfer device and held in place while the spray device 4 is passed into each can body in turn to coat it.

Although the present invention can be described in connection with preferred embodiments thereof, many variations and modifications will now become apparent to those skilled in the art. It is preferred, therefore, that the present invention be limited not by the specific disclosure herein, but only by the appended claims.

What is claimed is:

1. A method for the spray coating of the interior of hollow bodies, comprising the steps of:

spray coating a first region of the interior of a hollow body with a coating material by means of a relatively concentrated spray jet that is directed against the first region; and simultaneously coating a second region of the interior of the hollow body by spraying a cloud of atomized coating material for coating the interior of the hollow body, whereby the first region is coated more heavily than the second region of the interior of the hollow body.

2. The method of claim 1, wherein the step of spraying the cloud of coating material comprises atomizing the coating material inside the interior of the hollow body to produce the cloud of atomized material there.

3. The method of claim 2, comprising supplying the coating material for the spray coating and the simultaneous coating from a common supply of coating material.

4. The method of claim 3, further comprising the step of drawing the coating material for the spray coating from the supply of coating material upstream of and near to the atomizing step.

5. The method of claim 2, further comprising the step of homogenizing the common supply of coating material by means of eddying it.

* * * * *

UNITED STATES PATENT AND TRADEMARK OFFICE

CERTIFICATE OF CORRECTION

PATENT NO. : 4,376,143

DATED : March 8, 1983

INVENTOR(S) : ERNST LEHMANN

It is certified that error appears in the above-identified patent and that said Letters Patent are hereby corrected as shown below:

On cover page, at [73], line 1, change the Assignee's name to --RANSBURG-GEMA AG--

Signed and Sealed this

*Twenty-fourth* Day of *May 1983*

[SEAL]

*Attest:*

DONALD J. QUIGG

*Attesting Officer*

*Acting Commissioner of Patents and Trademarks*